United States Patent [19]

Miyabayashi et al.

[11] 4,073,170

[45] Feb. 14, 1978

[54] REMOTELY ACTUATED LOCK ARRANGEMENT FOR MOTOR VEHICLE

[75] Inventors: Yoshiyuki Miyabayashi, Tokyo; Yoshimasa Tsuchiya, Sayama, both of Japan

[73] Assignee: Nissan Motor Company, Limited, Japan

[21] Appl. No.: 653,902

[22] Filed: Jan. 30, 1976

[30] Foreign Application Priority Data

Jan. 31, 1975 Japan ..... 50-13005

[51] Int. Cl.[2] ..... E05B 65/12

[52] U.S. Cl. ..... 70/256; 292/216; 292/DIG. 25; 292/DIG. 37; 292/DIG. 43

[58] Field of Search ..... 70/256, 240, 241, 360, 70/237, 380; 292/216, DIG. 25, DIG. 37, DIG. 43

[56] References Cited

U.S. PATENT DOCUMENTS

| | | | |
|---|---|---|---|
| Re. 27,390 | 6/1972 | Allen | 292/DIG. 25 |
| 1,014,145 | 1/1912 | Graham | 70/256 |
| 1,550,379 | 8/1925 | Manteufel | 70/380 |
| 2,218,183 | 10/1940 | Springer | 70/149 |
| 2,603,963 | 7/1952 | Allen | 292/DIG. 37 |
| 2,608,428 | 8/1952 | Allen | 292/DIG. 37 |
| 2,877,039 | 3/1959 | Krause | 292/216 |
| 3,062,033 | 11/1962 | Schmalfeldt | 70/256 |
| 3,155,408 | 11/1964 | Peras | 292/216 |
| 3,917,330 | 11/1975 | Quantz | 292/216 |

FOREIGN PATENT DOCUMENTS

| | | | |
|---|---|---|---|
| 1,801,154 | 4/1970 | Germany | 70/240 |

*Primary Examiner*—Paul R. Gilliam
*Assistant Examiner*—Kenneth J. Dorner

[57] ABSTRACT

A motor vehicle has a luggage compartment with a lid secured closed by a lock operable both by a key, and by a knob disposed in the passenger compartment.

2 Claims, 5 Drawing Figures

REMOTELY ACTUATED LOCK ARRANGEMENT FOR MOTOR VEHICLE

The present invention relates to a remotely actuated lock arrangement for a motor vehicle.

A main object of the present invention is to enable an occupant of a vehicle to conveniently unlock an externally accessible compartment when desired, for example when passing through inspection.

According to the present invention a motor vehicle comprises an externally accessible compartment with a lid secured closed by a lock provided with a lock releasing member which is movable between lock and unlock positions by a key; a crank arm connected to the lock releasing member for integral movement with the lock releasing member and control means connected to the crank arm and having a manually operable part extending into the passenger compartment, the control means being operative for moving the lock releasing member between the lock and unlock positions in response to operation of the manually operable part.

The invention will now be more particularly described with reference to the accompanying drawings, in which.

Referring to the accompanying drawings, the same reference numerals are used throughout all Figures to designate like or similar parts.

Figure 1:
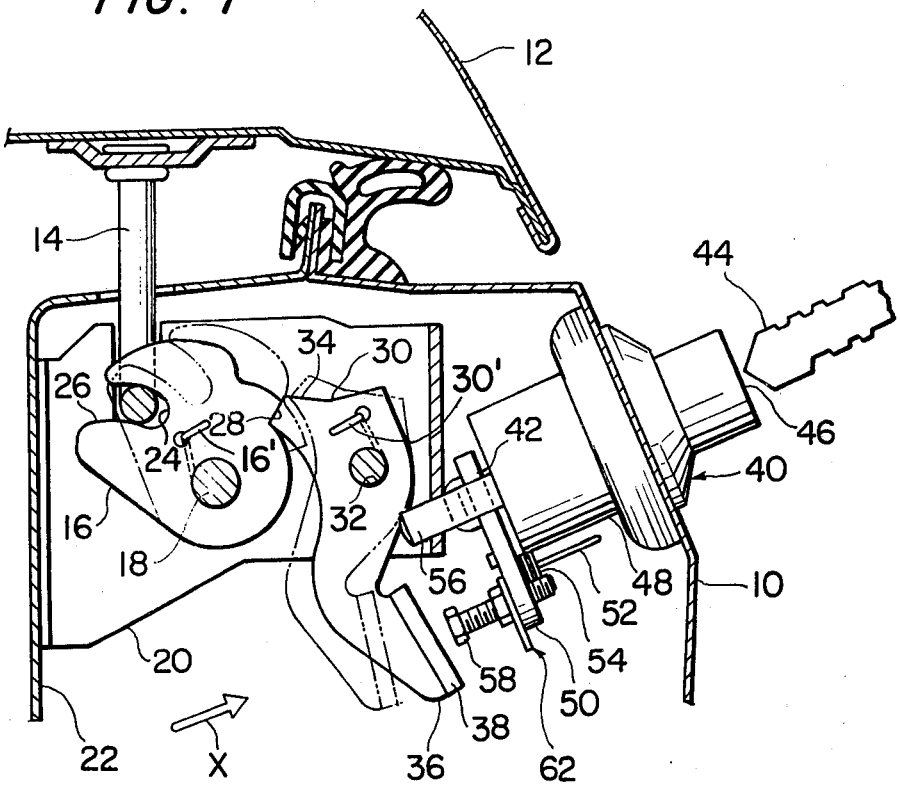
FIG. 1 is a sectional side elevation of a lock mechanism and a luggage compartment with a lid in which it is disposed.

In FIG. 1 there is shown a luggage compartment in a vehicle body 10 having a lid 12. A lock for the luggage compartment comprises a keeper 14, fixed to the lid 12, and a latch plate 16 pivoted at 18 in a casting 20 which in turn is secured to the luggage compartment wall at 22. The latch plate 16 has a keeper receiving recess 24 and an extended edge 26 designed to be struck by the keeper 14, when closing the lid 12, to rock the latch plate 16 against the force of a spring 16' which urges the latch plate in a clockwise direction as viewed. The latch plate 16 is also formed with a lock shoulder 28 for engagement by a co-operating detent 30, the latter being rockable on a pivot 32 against the force of a spring 30' which urges the detent 30 in a counterclockwise direction as viewed. The detent 30 is formed with a detent arm 34 positioned to engage the perimeter of the latch plate 16 and is also formed with an actuating arm 36 having a lug 38. A cylinder lock 40 is secured to the vehicle body in proximity to the arm 36 for rocking the latter clockwise to disengage the detent 30 and thereby release the latch plate 16 for unlocking the lid 12.

The cylinder lock 40 comprises a lock releasing plunger 42 which is rockable about an axis (not shown) between a "lock" and "unlock" position by a key 44 from the external of the vehicle body 10 and which projects along the axis from the cylinder lock when a push button 46 is manually pushed. The cylinder lock just mentioned is of a known type and often referred to as a "push button type."

The lock releasing plunger 42 is mounted in a casing 48 and has a crank arm 50 fixed thereon, which is rockable with the plunger 42 against one limb of a toggle spring 52 the other limb of which engages an eyelet 54 secured to the casing 48. With the toggle spring 52, the plunger 42 and crank arm 50 can snap to take "lock" or "unlock" position and since the other limb of the toggle spring 52 slidably extends through the eyelet 54, the plunger 42 and crank arm 50 can project from the casing 48 leftwardly as viewed in FIG. 1. Stops 56 and 57 are formed from the casing 48 to define the "lock" and "unlock" positions of the arm 50 and they extend in parallel leftwardly as viewed in FIG. 1 so that the crank arm 50 will slide on one of the stops 56 and 57 when the plunger 42 projects from the casing 48. The crank arm 50 is provided at a point spaced from the plunger 42 with a finger, in the form of a lock bolt 58, in such a manner that when the crank arm 50 is positioned to "lock" position by the operation of the key 44, the finger 58 is disaligned with the lug 38 of the actuating arm 36 so that the finger will fail to engage the lug 38 even if the push button 46 is pushed and that when the crank arm swings to the "unlock" position, the finger is aligned with the lug 38 so that the finger 58 will engage the lug 38 to rock the detent 30 clockwise to permit the latch plate 16 to release the keeper 14 or to free the lid 12 for being manually opened for inspection or other reason.

To unlock the lid 12 without the driver alighting from the vehicle and without the key 44, a control rod 60 is slidably mounted in proximity to the crank arm 50 and its control is extended to the driver's seat. The control rod 60 is operatively connected to the crank arm 50 by means of a link plate 62. The link plate 62 has one end **62*a* pivoted to the control rod 60 at 64 for rotatable movement within a plane which is arranged in substantially parallel with a direction along which the finger 58 moves when the push button 46 is pushed. The link plate 62 is turned substantially through 90° at its intermediate portion and has other end 62*b* loosely coupled with the finger 58 to be pivoted to the crank arm 50 so that longitudinal movement of the control rod 60 is converted to swingable movement of the crank arm 50. A nut 66 retains the other end 62*b* on the finger 58. The control rod 60 is connected to one end of an inner core 68 within an outer sheath 70 of a Boden cable through an idler case 72 which is fixed securely to a fixed portion of the vehicle body through a bracket 74. The other end of the inner core 68 is connected to a knob 76 mounted in a casing 78 which in turn is secured to a bracket 80** bolted securely to a fixed portion of the passenger compartment adjacent the driver's seat.

Figure 2:
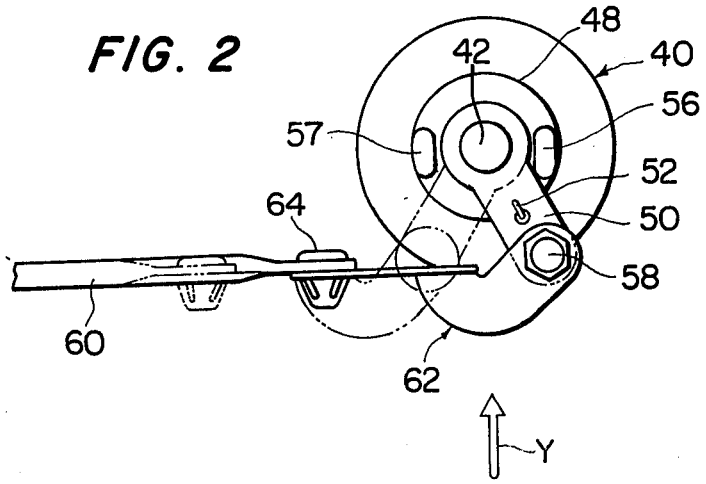
FIG. 2 is a side elevation of a part of the lock mechanism as viewed along an arrow X of FIG. 1.
Figure 3:
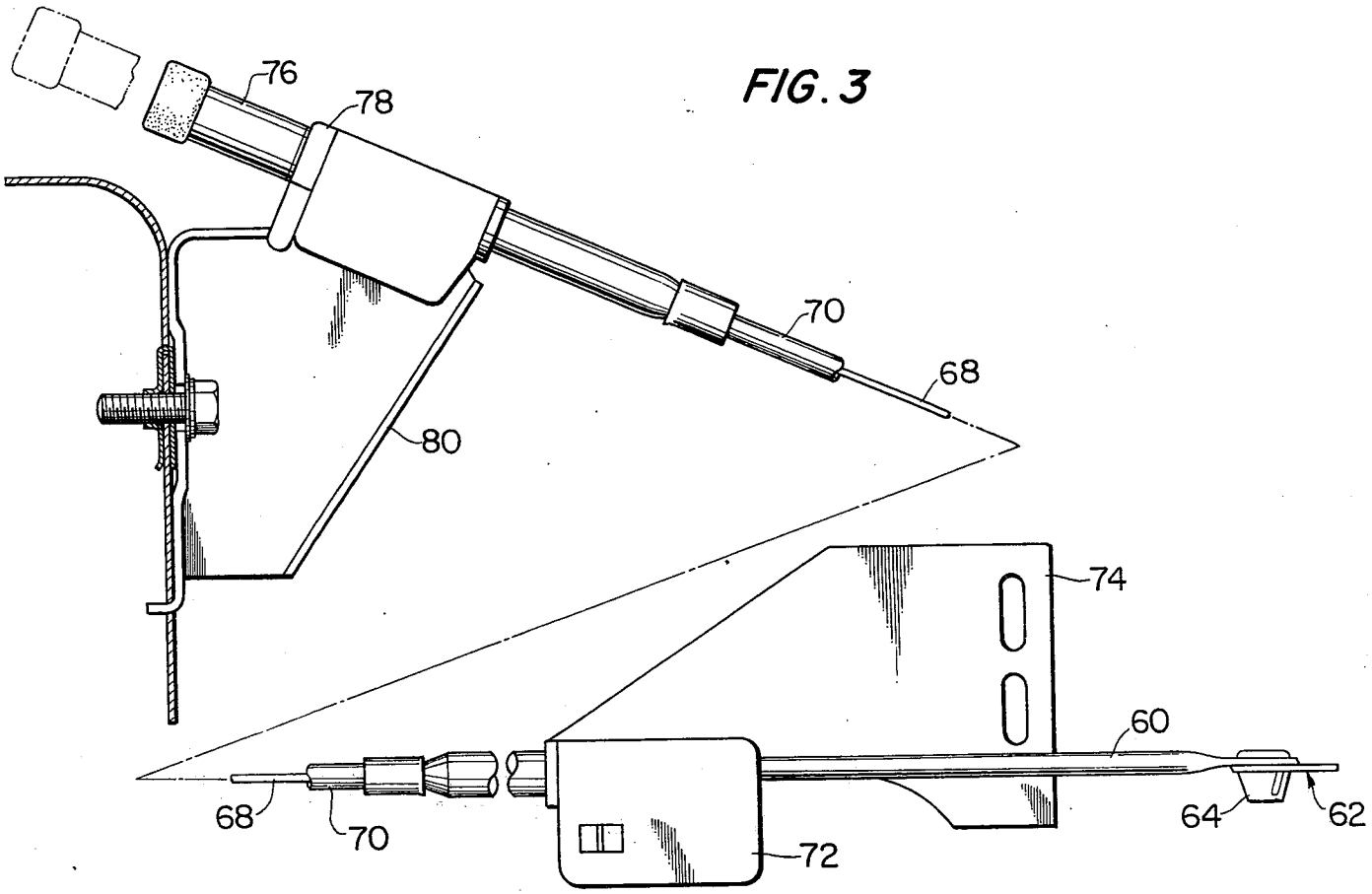
FIG. 3 is a sectional side elevation of a control rod. Boden cable and control knob for the lock mechanism.
Figure 4:
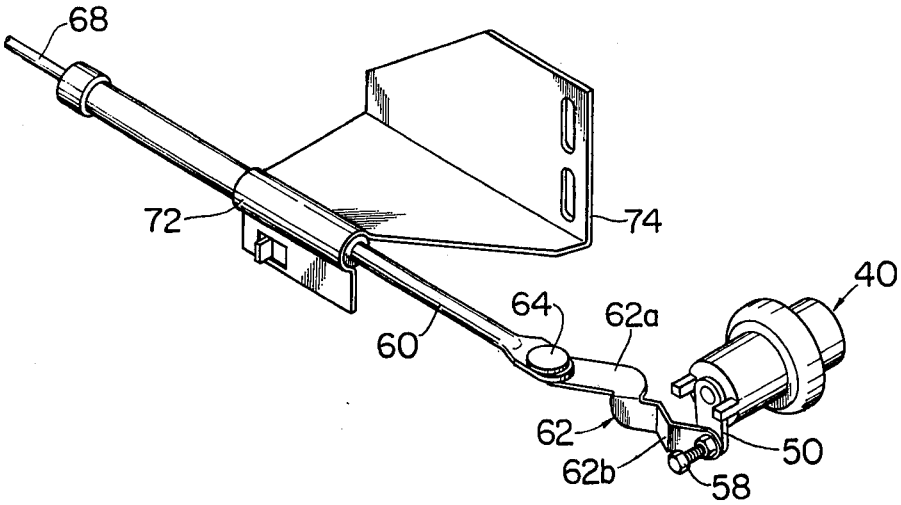
FIG. 4 is a perspective view of a link plate and control rod for a cylinder lock of the lock mechanism.
Figure 5:
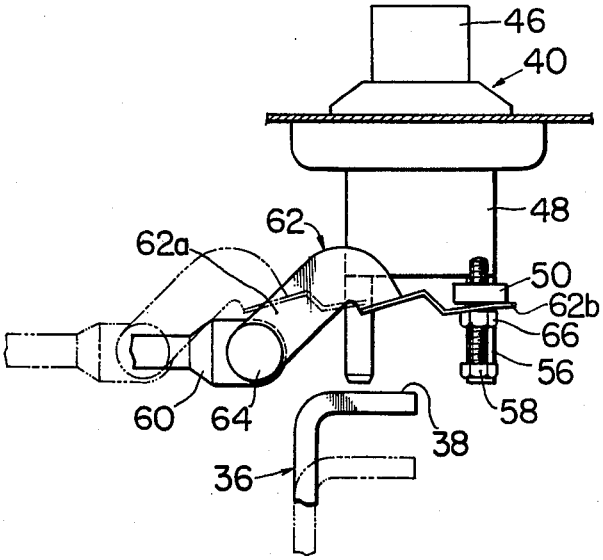
FIG. 5 is a side elevation of a part of the lock mechanism as viewed along an arrow Y of FIG. 2.

In opening the lid 12 the knob 76 is pulsed to the position illustrated in imaginary line as shown in FIG. 3, rocking the arm 50 to the "unlock" position illustrated in imaginary line as shown in FIG. 2 or 5 through the inner core 68, control rod 60 and link plate 62. If then the button 46 is pushed, the plunger 42, arm 50 and finger 58 moves toward the lug 38 of the actuating arm 36 to engage the same (see FIG. 5) to rock the detent clockwise (as viewed in FIG. 1) to the imaginary line position, permitting the latch plate 16 to rock to open position, indicated by the imaginary line, to free the keeper 14 and lid 12 for being manually opened.

When the control knob 76 is pushed to the position illustrated in solid line (see FIG. 3), rocking the arm 50 back to the position illustrated in solid line (see FIG. 2 or 5), then pushing the button 46 will not engage the finger 58, so that the lid 12 will not be manually opened even if the button 46 is pushed.

From the foregoing, it will be observed that the driver may unlock the luggage compartment from his seat by simply pulling on the knob 76 and thereby free the lid 12 for being manually opened if the push button 46 is pushed and may lock it by simply pushing the knob 76. It will be seen that when the lid 12 is closed the shoulder 28 and detent arm 34 will interlock to secure the lid 12 closed.

It will also be observed that since the link plate 62 pivotally carried by the control rod 60 is pivoted at a point spaced from the lock releasing plunger 42, the driver can manipulate the knob 76 easily.

It will still be observed that the lid 12 remains closed until the push button 46 is pushed even if the knob 76 is pulled. This is convenient when the lid 12 is to be opened on a rainy day.

It will also be observed that the risk of baggage being stolen from the luggage compartment 10 will be reduced because the driver may tell whether the lid 12 is locked or unlocked from his seat by seeing the positions of the knob 76.

It is desirable to provide a switch closable in response to one of the positions which the knob 76 can take and an alarm energized by the switch to let the driver to know that the lid 12 is unlocked. This will help reducing the possibility that the driver foregets locking the lid 12.

Although in the preferred embodiment the present invention is embodied in a lock releasable by a cylinder lock of the push button type, it can equally be embodied in a lock releasable by a cylinder lock which rocks an arm to permit a latch to free a keeper.

What is claimed is:

1. In a motor vehicle:

a passenger compartment;

a luggage compartment with a lid;

a casing secured within said luggage compartment;

a latch pivotably supported by said casing and having a latched position for securing said lid and an open position for releasing said lid;

a detent pivotably supported by said casing and operable in one position thereof to retain said latch in the latched position;

first spring means for biasing said latch toward an unlatched position from said latched position;

second spring means for biasing said detent toward said one position thereof;

finger means coactive with said detent in a first position thereof and manually operable from the outside of the motor vehicle to move said detent to release said latch, said finger means being movable between the first position thereof and a second position thereof in which said finger means is out of coactive condition with said detent;

key operable means for moving said finger means between the first and second positions thereof, said key operable means being operable by a key from the outside of the motor vehicle, said key operable means including a swingable arm carrying said finger means, means for toggle operating said arm and first and second stop means fixed with respect to said arm, said first stop means being operative for limiting swingable movement of said arm to define the first position of said finger means, said second stop means being operative for limiting swingable movement of said arm to define the second position of said finger means;

control means for moving said finger means between the first and second positions thereof, said control means being manually operable from said passenger compartment, said control means including a link plate operatively connected to said arm and a manually operable part extending into said passenger compartment, said manually operable control means being operable by said manually operable part to move said arm between said first and second stop means.

2. In a motor vehicle:

a passenger compartment;

a luggage compartment with a lid;

a casing secured within said luggage compartment;

a latch pivotably supported by said casing and having a latched position for securing said lid and an open position for releasing said lid;

a detent pivotably supported by said casing and operable in one position thereof to retain said latch in the latched position, said detent having an actuating arm;

first spring means for biasing said latch toward an unlatched position from said latched position;

second spring means for biasing said detent toward said one position thereof;

finger means having a first position in which said finger means is in coactive condition with said actuating arm to move said detent to release said latch and having a second position in which said finger means is out of coactive condition with said actuating arm;

means for manually operating said finger means from outside of the motor vehicle;

key operable means for moving said finger means between the first and second position thereof, said key operable means being operable by a key from the outside of the motor vehicle, key operable means including a swingable arm carrying said finger means, means for toggle operating said swingable arm and first and second stop means fixed with respect to said swingable arm, said first stop means being operative for limiting swingable movement of said swingable arm to define the first position of said finger means, said second stop means being operative for limiting swingable movement of said swingable arm to define the second position of said finger means in which even if said manually operating means is operated, said finger means will fail to engage said actuating arm;

remote control means for moving said finger means between the first and second positions thereof, said remote control means being manually operable from said passenger compartment, said remote control means including a link plate operatively connected to said swingable arm and a manually operable part extending into said passenger compartment, said manually operable control means being operable by said manually operable part to move said swingable arm between said first and second stop means.

* * * * *